US005256278A

United States Patent [19]

Rindt et al.

[11] Patent Number: 5,256,278

[45] Date of Patent: Oct. 26, 1993

[54] DIRECT COAL LIQUEFACTION PROCESS

[75] Inventors: John R. Rindt; Melanie D. Hetland, both of Grand Forks, N. Dak.

[73] Assignee: Energy and Environmental Research Center Foundation (EERC Foundation), Grand Forks, N. Dak.

[21] Appl. No.: 843,909

[22] Filed: Feb. 27, 1992

[51] Int. Cl.[5] ..... C10G 1/00; C10G 1/06

[52] U.S. Cl. ..... 208/400; 208/403; 208/428; 208/430; 208/431; 208/435; 44/620

[58] Field of Search ..... 208/400, 403, 428, 430, 208/431, 435, 2; 44/620

[56] References Cited

U.S. PATENT DOCUMENTS

| | | | |
|---|---|---|---|
| 3,813,329 | 5/1974 | Gatsis | 208/390 |
| 3,884,794 | 5/1975 | Bull et al. | 208/8 |
| 3,920,536 | 11/1975 | Seitzer et al. | 208/951 |
| 3,997,424 | 12/1976 | Urquhart | 208/400 |
| 4,047,898 | 9/1977 | Cole et al. | 44/1 G |
| 4,094,765 | 6/1978 | Bearden et al. | 208/430 |
| 4,128,471 | 12/1978 | Malone et al. | 208/414 |
| 4,133,646 | 1/1979 | Farcasiu et al. | 44/1 R |
| 4,202,756 | 5/1980 | Murakami et al. | 208/8 LE |
| 4,250,014 | 2/1981 | Long et al. | 208/8 LE |
| 4,583,990 | 4/1986 | McGarry et al. | 44/51 |
| 4,846,963 | 7/1989 | Knudson et al. | 208/431 |
| 5,017,282 | 5/1991 | Delbianco et al. | 208/435 |
| 5,151,173 | 9/1992 | Vaughn et al. | 208/430 |

*Primary Examiner*—Theodore Morris
*Assistant Examiner*—P. L. Hailey
*Attorney, Agent, or Firm*—Zarley, McKee, Thomte, Voorhees & Sease

[57] ABSTRACT

An improved multistep liquefaction process for organic carbonaceous material which produces a virtually completely solvent-soluble carbonaceous liquid product. The solubilized product may be more amenable to further processing than liquid products produced by current methods. In the initial processing step, the finely divided organic carbonaceous material is treated with a hydrocarbonaceous pasting solvent containing from 10% and 100% by weight process-derived phenolic species at a temperature within the range of 300° C. to 400° C. for typically from 2 minutes to 120 minutes in the presence of a carbon monoxide reductant and an optional hydrogen sulfide reaction promoter in an amount ranging from 0 to 10% by weight of the moisture- and ash-free organic carbonaceous material fed to the system. As a result, hydrogen is generated via the water/gas shift reaction at a rate necessary to prevent condensation reactions. In a second step, the reaction product of the first step is hydrogenated.

20 Claims, No Drawings

DIRECT COAL LIQUEFACTION PROCESS

GRANT REFERENCE

This invention was made with Government support under Cooperative Agreement No. DE-FC21-86MC10637 with the Department of Energy. The Government has certain rights in this invention.

BACKGROUND OF THE INVENTION

This invention relates to coal liquefaction processing. Coal liquefaction is of course known. Direct liquefaction is a process in which coal is converted to liquid products. This is accomplished by adding hydrogen to coal that has been slurried in a solvent, with the hydrogen addition taking place at elevated temperatures and pressures. The process was invented in 1913 and has remained relatively unchanged since its extensive use by Germany during World War II. Currently, direct liquefaction processes are usually performed in two stages using high-rank coals and operated at temperatures greater than 400° C. and pressures of approximately 2500 psi. Catalysts, which are very expensive, are generally used in both stages. While the economics of direct liquefaction have improved during the last five years, it is not yet a commercially viable method of producing liquid fuels due to its use of catalysts in both stages and the severity of the conditions employed.

Work performed early in the 1980's showed that low-rank coals are very reactive. It seems logical that they could be cost-effectively substituted into the direct liquefaction process since they would most likely require less severe reaction conditions. However, most attempts to use low-rank coals during direct liquefaction have not successfully produced high yields of top-quality liquid product possibly because the coal reacts too rapidly for the available hydrogen source(s), resulting in the production of retrograded material. Any successful use of low-rank coals in direct liquefaction requires that advantage be taken of their positive characteristics. This is highly unlikely with the current direct liquefaction approach, which assumes that the reactions occurring at the usually severe conditions provide the best (or only) way to convert coal to liquid products.

In short, currently-used liquefaction processes do not provide high yields of desirable liquid products for low-rank coals because it has generally been assumed in the past that the conditions suitable for high-rank coal would also be suitable for low-rank coal. This has been found to not be the case because the coals are inherently different.

Low-rank coals have higher ash and moisture contents than high-rank coals. More importantly, low-rank coals contain more oxygen (on a moisture-free basis) than do high-rank coals. It is their high oxygen content which makes them quite reactive. A typical low-rank coal would have a moisture content within the range 25 wt. % to 67 wt. %, an ash content of <1 wt. % to 40 wt. %, and an oxygen content within the range of from 15 wt. % to 25 wt. %, all values on a moisture-free basis.

Typical coals that can be classified as low-rank include brown coal, lignite, and subbituminous coal. The present invention may make use of virtually any organic carbonaceous material as a feedstock, including, but not limited to, low-rank coals, high-rank coals, leonardite, peat, wood, biomass, and even organic garbage. The yield and quality of the product would be determined by the choice of organic feedstock. However, the present invention provides the opportunity to attain relatively high conversions to liquid products for low-rank coals and poor-quality organic materials.

The present invention was conceived by viewing direct coal liquefaction in a manner that is substantially different than is currently typical. For this invention, the initial treatment stage is regarded as the initial solubilization of the coal in a solvent such that it is, in effect, reversed coalification. Subsequent upgrading can then be thought of as refining. The underlying assumption of this type of processing, demonstrated by the higher yields of desirable liquid products achieved by this invention using low-rank coal, is that the structure of the coal is comprised of physically and chemically tangled, highly cross-linked molecules. The molecular structures of petroleum distillate fuels (the desired product) by comparison, are discreet molecules of similar size and chemical nature, having virtually no chemical or physical attachments. The goal of the process is therefore to go from a chemical "knot" to an orderly structure. In this process, the first phase liquefaction should therefore be to "untangle" the coal structure at low-severity conditions to prevent coalification (retrograde) reactions, while the second phase should be to "organize" the untangled pieces so that those of similar size and chemical nature are first separated from the remaining material and then stabilized to prevent back reactions. In accordance with this mechanistic view, the present invention was specifically designed for low-rank coals to accomplish high-yield liquefaction with minimum retrograde reactions.

The purpose of liquefaction is to provide economical sources of carbonaceous liquid product which may be used either as energy sources or in creating other products. If the economics are incorrect, i.e., if the yield of desired liquid product is low, then the whole idea of using the process is simply defeated. Importantly too, is the fact that because large volumes of materials are treated, very small differences in efficiency or liquid product yield mean substantially significant differences in process economics.

Accordingly, it can be seen that there is a continuing need for the development of coal liquefaction processes which are specifically tailored to low-rank coals and other organic carbonaceous materials, and which provide high yields of desired liquid products. This invention has as its primary objective the fulfillment of this need.

The method and manner of accomplishing this objective will become apparent from the detailed description which follow hereinafter.

SUMMARY OF THE INVENTION

Organic carbonaceous material is treated in a multistep processing sequence. The first step consists of treating the organic carbonaceous material with a hydrocarbonaceous pasting solvent containing from 10 wt. % to 100 wt. % phenolic fractions. First-step processing takes place at a temperature of from about 300° C. to about 400° C., typically for 2 minutes to 120 minutes, in the presence of carbon monoxide reductant and, optionally, hydrogen sulfide reaction promoter. The use of carbon monoxide enables advantage to be taken of the nascent hydrogen produced during the water/gas shift reaction. Hydrogen is therefore readily available in the correct form necessary for reaction with very reactive organic carbonaceous material such as low-rank coal, and less retrograde material is produced. The product of the initial step is hydrogenated at a temperature of from 400° C. to 460° C. for from 1 minute to 20 minutes.

This multistep processing sequence can also be preceded by an optional pretreatment step consisting of a reaction of the organic carbonaceous material in a hydrogen-donating solvent at a temperature of from 110° C. to 250° C. for from 1 minute to 120 minutes in the presence of an inert gas and hydrogen sulfide.

DETAILED DESCRIPTION OF THE INVENTION

The process of this invention takes advantage of the chemistry specific to low-rank coals and is therefore more effective and efficient than current liquefaction processes which have generally been designed with high-rank coals in mind. The mechanistic view adopted during the development of this invention is that the structure of low-rank coal (or other organic carbonaceous material) is comprised of physically and chemically tangled, highly cross-linked molecules. The molecular structures of petroleum distillate fuels (the desired product) by comparison, are discreet molecules of similar size and chemical nature, having virtually no chemical or physical attachments. The goal of the process is therefore to go from a chemical "knot" to an orderly structure. In this process, the first phase liquefaction should therefore be to "untangle" the coal structure at low-severity conditions to prevent coalification (retrograde) reactions while the second phase should be to "organize" the untangled pieces so that those of similar size and chemical nature are first separated from the remaining material and then stabilized to prevent back reactions. In accordance with this mechanistic view, the present invention was specifically designed for low-rank coals to accomplish high-yield liquefaction with minimum retrograde reactions.

Generally speaking, liquefaction reactors are closed reaction vessel systems well known to the art and need not be described in detail herein. For an example of a typical flow diagram for these reactors, see Farcasiu et. al., U.S. Pat. No. 4,133,646 issued Jan. 9, 1979. They usually operate under pressure of from 2,500 psig to 4,000 psig.

According to the process of the present invention, the organic carbonaceous material, preferably low-rank coal, is initially subdivided. Typically, it is ground or subdivided in a ball mill, hammer mill, roller mill, etc., to a screen size of minus ¼ inch. Size is not critical, except that it must be sufficiently reduced in size so that 1) it can form a pumpable slurry when combined with a pasting solvent, and 2) it can interact with the solvent.

In the initial or first step of this invention, it has been found important that the pasting solvent have a phenolic content of from 10 wt. % to 100 wt. %. It is preferable that it be a process derived solvent. Typical phenolic solvents include those which are $C_6$ and $C_{14}$ phenolics and include alkyl phenolics with the alkyl group of from $C_1$ and $C_6$. Fused aromatic rings which have phenolic functional groups and alkyl side constituents are also contemplated. Typical examples would include phenol, cresol, cumol, ethylphenol, butylphenol, and isobutylphenol. It is preferred that the pasting solvent be process derived because organic materials seem to be more easily solubilized in organically-derived solvents. Generally, the solvent-to-organic carbonaceous material ratio should be within the range of from about 1:1 to about 10:1, and most preferable is about 2:1.

In this initial step, the temperature should be lower than the temperatures usually used for high-rank coals. First-step temperature typically ranges from about 300° C. to about 400° C., most preferably within the range of about 350° to about 375° C. These are considered moderate temperatures for coal liquefaction processes. This initial treatment can take from 2 minutes to 120 minutes, but preferably occurs within the range of from 20 minutes to 60 minutes.

In normal high-rank coal processing, this initial step is conducted in the presence of a hydrogen-donating solvent, hydrogen gas, and a catalyst. The process of this invention differs considerably from the high-rank coal processing in that it makes use of the water/gas shift reaction to provide hydrogen in a manner much more appropriate for highly reactive organic carbonaceous material. Hydrogen gas is relatively stable at the milder conditions used in this invention, and at these conditions does not readily make elemental hydrogen available for hydrogenation. Therefore, the process of this invention uses carbon monoxide as the reductant in order to take advantage of the water/gas shift reaction ($CO+H_2O$ $CO_2+2H \cdot CO_2+H_2$) to produce the elemental hydrogen used during reaction. The carbon dioxide reacts with water that is present in the low-rank coal (or other organic carbonaceous material) to yield carbon dioxide and hydrogen. The amount of carbon monoxide should be an amount which will provide a hydrogen availability equivalent of from 0.5% to about 5% by weight of the moisture- and ash-free (maf) organic carbonaceous material. As an option, hydrogen sulfide can be used to promote the water/gas shift reaction and to effectively move the hydrogen throughout the system to allow more intimate interaction with the coal. The amount of hydrogen sulfide should be from 0% to about 10% by weight of the maf organic carbonaceous feed into the system. Conducting this first step in the presence of carbon monoxide reductant and, optionally, with hydrogen sulfide promoter, is critical for high yield liquefaction of low-rank coal and is a feature that is unique to this invention.

The temperature should be maintained within the earlier expressed range of from 300° C. to 400° C., preferably from 350° C. to 375° C. At higher temperatures, i.e. above 400° C., the products tend to retrograde. Thermal cracking begins to occur at temperatures above 400° C. and alkane gases such as methane, ethane, propane, and butane are generated. Production of these gases is undesirable from an economic standpoint for a liquefaction process, since substantial amounts of carbon are diverted from production of liquids.

The reactive portions of the organic carbonaceous material are converted to solvent-soluble material during the first step. The material that did not convert requires more severe conditions to convert it to solvent-soluble material. A second step is, therefore, performed at more severe conditions so as to convert this remaining material.

The product slurry from the first step (containing solvent, solvent-soluble material, and unconverted material) is fed to the second step, which consists of hydrogenation using hydrogen gas at temperatures from about 400° C. to about 460° C. for from 1 to 20 minutes. Additional processing solvent is added during the second step. During the second step, the unconverted material is converted to solvent-soluble material. The two-step process results in very high conversion of the organic carbonaceous material to solvent-soluble material, with minimal gaseous product conversion.

If desired, and the process economics of a particular system warrant, an initial pretreatment can be used prior to the two-step process treatment just described. In particular, before the water/gas shift reaction occurs in the presence of carbon monoxide reductant and hydrogen sulfide reaction promoter, the subdivided coal can be pretreated.

In this pretreatment, the subdivided coal is subjected to a hydrogen donor solvent for from 1 minute to 120 minutes at a very low temperature, i.e., from 110° C. to 250° C., in the presence of an inert gas such as argon. It has been found that this initial pretreatment will even further increase liquid product yield at the expense of gaseous product production. In this step, the solvent should be a hydrogen donor solvent. A typical hydrogen donor solvent can consist of relatively high-boiling hydroaromatic materials such as those containing polycyclic aromatics or partially hydrogenated aromatic solvents such as tetralin, hydrogenated anthracene oil, hydrogenated coal tars, etc.

Based upon results using pretreatment prior to the Step 1 solubilization process, it has been demonstrated that the pretreatment can reduce the production of gaseous species by approximately one half while increasing liquid production. The entire process where pretreatment is employed may ultimately provide a significant improvement in the typical yield structure currently attained during direct liquefaction processing. In fact, the products of the present invention appear to be of higher quality.

The process of the present invention may be used to achieve bigger yields of higher quality liquid products at a lower cost than current direct liquefaction processes. For example, applying this process to a typical low-rank coal will provide the following cost benefits: at a typical cost of $10 per ton, low-rank coals are less expensive than higher-rank coals which typically cost $30 per ton; the present process does not make use of an expensive catalyst; the present process uses carbon monoxide or synthesis gas (a mixture of carbon monoxide and hydrogen) rather than a pure hydrogen in the first stage, eliminating the need for costly hydrogen purification in this part of the process; and finally, this process employs lower-severity reaction conditions for the bulk of the processing which are less costly than conditions currently employed in coal liquefaction. Thus, economics are better and the process is more efficient.

The following examples illustrate the process of the present invention.

EXAMPLES

The specific examples described below illustrate the effectiveness of the present invention in terms of importance of the treatment sequence to the success of converting low-rank coal to liquid product. In each of the runs the coal utilized was lignite, particularly lignite obtained from the Indian Head mine near Zap, N. Dak. The success of the process was judged by the conversion of lignite to tetrahydrofuran- (THF-) soluble material as well as the product yield structure. The higher the percent THF solubles on a weight-percent basis, the more successful the conversion. Generally speaking, if the THF solubility of the liquid product nears 100%, conversion to non-solid products is virtually complete.

EXAMPLE 1

Table 1 as set forth below summarizes runs performed using phenolic pasting solvent. The first step was performed at 374° C. for 60 minutes. Hydrogen sulfide was added as a reaction promoter in an amount equal to 5% by weight of the maf coal, while the quantity of carbon monoxide reductant equalled 4.32% by weight of the maf coal. The pressure was maintained at 3,470 psig. The ratio of pasting solvent to coal was 2.03:1. Following the first step, a hydrotreatment additive was added in an amount equivalent to 1 wt. % to 2 wt. % of the maf coal fed to the system. Hydrotreated anthracene oil was added to Sample 1, while phenolic solvent was added to Sample 2. The Step 1 product slurries plus hydrotreatment additives were then hydrogenated in Step 2. Step 2 was performed at 425° C. for 20 minutes at a hydrogen reductant pressure of about 3,500 psig. Table 1 below shows the resulting product slates for the two tests.

TABLE 1

MASS BALANCES AND PRODUCT SLATES OF THE LOW-SEVERITY LIQUEFACTION TESTS FOLLOWING STEP 2

| Hydrotreatment Additive | Sample 1 Hydrotreated Anthracene Oil | Sample 2 Phenolic Solvent |
|---|---|---|
| Material Balance, wt % | 96.91 | 97.40 |
| Solvent Recovery, wt % | 102.36 | 100.30 |
| Conversion to THF Solubles, wt % | 96.44 | 101.56 |
| Product Slate, wt % MAF coal in[a] | | |
| CO | −34.82 | −36.12 |
| $H_2$ | −0.79 | −0.64 |
| $CO_2$ | 66.78 | 67.35 |
| C1-C3 | 2.14 | 2.22 |
| $H_2S$ | 2.53 | −1.64 |
| $H_2O$ | −23.32 | −16.90 |
| Ash | −1.13 | −2.56 |
| IOM[b] | 4.91 | −2.03 |
| Distillable Oils | 11.99 | 1.47 |
| THF-Soluble Residuum | 76.78 | 88.85 |

[a]Positive values indicate production of the component; negative values indicate consumption. All values given are wt % of maf coal fed to the system.
[b]Insoluble organic material.

The purpose of the process of this invention is to virtually completely solubilize the organic carbonaceous material so that it may react more favorable to further processing. The quantities of soluble materials (distillate oils plus soluble residuum) produced during these tests (88.77 wt. % for Sample 1 and 90.32 wt. % for Sample 2) indicate that the process of this invention can achieve high conversions to soluble materials using low-rank coal.

Further tests were performed to compare the hydrotreatability of the product of the multistep process of this invention with that of current direct liquefaction firststage processing. Because the product generated as Sample 2 was not fresh enough, a duplicate run was performed at Step 1 and Step 2 conditions that were virtually identical to those used to produce Sample 2. The light distillable oil (boiling point of 210° C. at atmospheric pressure) from the duplicate run was recovered and saved. The bottoms were subjected to further processing under catalytic upgrading conditions. In particular, the upgrading was performed at a temperature of 426° C. and a pressure of 3,000 psig using Shell 424 catalyst. Hydrogen was run until no uptake was observed; i.e., approximately 2.5 hours. The hydrotreating step resulted in the production of pentane-soluble material equalling 76±2 wt. % of the maf coal fed to the system. The light distillable oil that had been recovered after Step 2 equalled 7.5 wt. % of the maf coal fed to the system, making the total liquids production for the entire process (Step 1 and Step 2 of this invention plus catalytic hydrotreating) equal to 83.5±2 wt. % of the maf coal fed to the system in Step 1. The yield structure of the hydrotreated Sample 2 duplicate run is presented in Table 2.

TABLE 2

| Yield Structure for Sample 2 | |
|---|---|
| 13.7% | maf equivalent out as $CO_2$ |
| 1.8% | maf equivalent out as C1–C3 hydrocarbon gases |
| 7.5% | maf equivalent out as excess light coal-derived pasting solvent |
| 76 ± 2% | maf equivalent out as pentane solubles (distillate) |
| 0% | maf equivalent out as soluble residuum |
| 0% | maf equivalent carbon rejection with ash |
| 99 ± 2 | Variance is primary N&S pathway and analytical/mass balance |

There was no THF-soluble material remaining with the catalyst or ash residue after the catalytic stage. The calculated amount of ash plus catalyst out of the catalytic stage was 52.2 grams, while the recovered amount was 52.4 grams. Little carbon remained with either the ash or catalyst as the ash was grey and catalyst green; i.e., neither was discolored by significant carbon deposition. All of the runs in this series have been duplicated and have produced the same results within analytical error.

EXAMPLE 2

Tables 3 and 4 summarize the results of runs performed to compare pretreated and nonpretreated tests. Table 3 summarizes the results of pretreatment of typical single-stage direct liquefaction (not the process of this invention). The comparison is with regard to the effect of the pretreatment on subsequent processing. Processing conditions for the single-stage tests were a temperature of 420° C., pressure ranging up to about 3,700 psig, and a residence time of 20 minutes. Relative to Sample 4, pretreatment of Sample 3 slightly increased the overall conversion of the lignite after single-stage processing, but the more positive results were the significant improvement in product yield structure noted by increased yield of soluble products and the accompanying decrease in gas make, both $CO_2$ and $C_1$–$C_3$ hydrocarbon gases.

TABLE 3

PRODUCT SLATES OF PRETREATED PLUS SINGLE-STAGE AND SINGLE-STAGE TESTS USING AO4

| Run No. | Sample 3 | Sample 4 |
|---|---|---|
| Solvent | Anthracene oil | Anthracene oil |
| Additive (lower case) | None | None |
| Gas | $H_2$ | $H_2$ |
| Residence Time, min[a] | 60/20 | 20 |
| Avg. Temp., °C.[a] | 175/410 | 420 |
| Avg. Pressure, psi | 2043/3600 | 3734 |
| Conversion, % | 60.7 | 55.5 |
| Products[b] | | |
| CO | 0.43 | 0.0 |
| $H_2$ | −0.71 | −1.87 |
| $CO_2$ | 10.18 | 21.58 |
| C1–C3 | 1.45 | 10.21 |
| $H_2S$ | 0.11 | 0.00 |
| Total Gas | 11.46 | 29.92 |
| $H_2O$ | −1.11 | 2.15 |
| Ash | −0.07 | −0.34 |

TABLE 3-continued

PRODUCT SLATES OF PRETREATED PLUS SINGLE-STAGE AND SINGLE-STAGE TESTS USING AO4

| Run No. | Sample 3 | Sample 4 |
|---|---|---|
| IOM | 39.31 | 44.51 |
| Solubles | 50.41 | 23.75 |
| Total Liquid | 88.54 | 70.08 |

[a]First value refers to pretreatment, second value refers to typical single-stage liquefaction.
[b]Values given as wt % of maf coal fed to system.

The results of these tests indicate that this specific pretreatment can improve the product slate of low-rank colas during direct liquefaction.

EXAMPLE 3

A second set of data shows a comparison of unpretreated and pretreated runs using lignite and hydrotreated solvent (hydrogenated anthracene oil) in the process of this invention. The product slates of the products of pretreatment plus Step 1 (Sample 6) and Step 1 (Sample 5) are shown in Table 4. Comparison shows slightly decreased conversion but a more significant shift in yield from gas production to increased liquids when the sample was pretreated.

TABLE 4

Comparison of Pretreated and Non-Pretreated Tests

| | Liquefaction | |
|---|---|---|
| | Non-Pretreated Sample 5 | Pretreated Sample 6 |
| Solvent | Hydrogenated Anthracene Oil | Hydrogenated Anthracene Oil/ PS after pretreatment |
| Additive | — | $H_2S$/None |
| Gas | CO | Ar/CO |
| Residence Time, min | 62 | 60/60 |
| Avg. Temp., °C. | 373 | 176/376 |
| Max. Temp., °C. | 376 | 178/381 |
| Avg. Pressure, psi | 3665 | 2000/3434 |
| Max. Pressure, psi | 3740 | 2000/3560 |
| Conversion, % | 87.7 | 81.0 |
| Products[a] | | |
| CO | −33.63 | −54.25 |
| $H_2$ | 0.41 | 1.01 |
| $CO_2$ | 65.04 | 73.46 |
| C1–C3 | 1.03 | 0.97 |
| $H_2S$ | 0.06 | 2.90 |
| Total Gas | 32.91 | 24.09 |
| $H_2O$ | −12.96 | −22.75 |
| Ash | −0.81 | −0.96 |
| IOM | 12.35 | 18.97 |
| THF Solubles | 68.50 | 80.65 |
| Total Liquid | 67.08 | 75.91 |

[a]Values given as wt % of maf coal fed to system

The conditions of the first-step treatment during these two tests were identical with the conditions expressed with regard to the runs of Example 1. This pretreatment was performed with hydrogenated anthracene oil as the solvent. To maintain effectiveness of the first step of this invention, a fraction of phenolic solvent comprising from 10 wt. % to 100 wt. % of the total solvent in the system may need to be maintained in the slurry entering the multistep treatment. This can be accomplished by 1) not fractionating the recycle solvent; 2) fractionating, concentrating, and recycling the phenolic portion of the solvent prior to hydrotreatment; or 3) dilution of the solvent with fresh, once-through feedstock.

What is claimed is:

1. A method of liquefaction of coal material, said method comprising;

(a) treating subdivided coal material with a hydrocarbonaceous pasting solvent containing from about 10% to about 100wt. % phenolic solvents selected from the group consisting of $C_6$–$C_{14}$ phenolics and alkyl phenolics having alkyl groups of from $C_1$ to $C_6$ at a temperature of from about 300° C. to about 400° C. for up to 120 minutes in the presence of carbon monoxide reductant to produce a product slurry; and thereinafter (b) hydrogenating the product slurry of step (a) at a temperature of from about 400° C. to about 460+ C. for from about 1 minute to about 20 minutes in the presence of hydrogen reductant and additional pasting solvent to provide a liquefied product.

2. The process of claim 1 wherein the carbon monoxide reductant is mixed with hydrogen sulfide reaction promoter.

3. The process of claim 2 wherein the amount of hydrogen sulfide is from 0% to about 10% by weight of the moisture and ash free coal material fed to the system.

4. The process of claim 1 wherein the coal material is low rank coal.

5. The process of claim 1 wherein the pasting solvent is selected from the group consisting of $C_6$ to $C_{14}$ phenolics.

6. The process of claim 5 wherein the pasting solvent is an alkylphenol having alkyl groups of from $C_1$ to $C_6$.

7. The process of claim 1 wherein the solvent-to-coal material ratio is within the range of from 1:1 to 10:1.

8. The process of claim 7 wherein the solvent-to-coal material ratio is about 2:1.

9. The process of claim 1 wherein the amount of carbon monoxide present is an amount which provides a hydrogen availability equivalent of from about 0.5% to about 5% by weight of the moisture and ash free coal material.

10. The process of claim 1 wherein the temperature is from about 350° C. to about 375° C.

11. The process of claim 1 wherein the residence time is from about 20 minutes to about 60 minutes.

12. The process of claim 1 wherein prior to the treatment, the subdivided coal material is subjected to a pretreatment step comprising preheating the coal material with a hydrogen-donor solvent for from about 1 minute to about 120 minutes at a temperature of from 11° C. to 250° C. in the presence of an inert gas and hydrogen sulfide in an amount ranging from 0 wt. % to about 10 wt. % of the moisture and ash free coal material.

13. The process of claim 12 wherein the inert gas is argon.

14. The process of claim 12 wherein the temperature is about 175° C.

15. The process of claim 12 wherein the solvent for the pretreatment is a solvent mixture which is comprised of from 10 wt. % to 100 wt. % phenolic solvent and the balance hydrogen-donor solvent.

16. The process of claim 12 wherein the pretreatment is used prior to other direct liquefaction processes.

17. The process of claim 16 wherein the solvent for the pretreatment is a solvent mixture which is comprised of from 10 wt. % to 100 wt. % phenolic solvent and the balance hydrogen-donor solvent.

18. The process of claim 1 wherein the product slurry from any step or combination of steps of the process is used as a feedstock to further processing to produce a distillate product.

19. The process of claim 1 wherein the product slurry from any step or combination of steps of the process is used as feedstock to further processing to produce chemicals.

20. The process of claim 1 wherein the product slurry from any step or combination of steps of the process is used as liquid, carbonaceous feedstock to further processing to produce composite matrix elements.

* * * * *